US005433147A

United States Patent [19]

Brede et al.

[11] Patent Number: 5,433,147

[45] Date of Patent: Jul. 18, 1995

[54] IGNITION DEVICE

[75] Inventors: Uwe Brede; Anton Bretfeld, both of Fürth; Peter Cornelius, Wilhermsdorf; Hans Jena, Fürth, all of Germany

[73] Assignee: Dynamit Nobel Aktiengesellschaft, Troisdorf, Germany

[21] Appl. No.: 209,881

[22] Filed: Mar. 14, 1994

[30] Foreign Application Priority Data

Mar. 12, 1993 [DE] Germany ..... 43 07 774.9

[51] Int. Cl.[6] ..... F42C 19/12

[52] U.S. Cl. ..... 102/202.2; 102/202.5; 102/202.9; 102/472; 102/530; 280/741; 422/166

[58] Field of Search ..... 102/202.1, 202.2, 202.3, 102/202.4, 202.5, 202.7, 202.9, 202.12, 202.14, 472, 530, 531; 280/741; 422/166

[56] References Cited

U.S. PATENT DOCUMENTS

| | | | |
|---|---|---|---|
| 3,180,263 | 4/1965 | Williams, Jr. | 102/202.2 |
| 3,763,782 | 10/1973 | Bendler et al. | 102/202 |
| 3,971,320 | 7/1976 | Lee . | |
| 4,271,453 | 6/1981 | Yajima et al. | 102/202.9 |
| 4,734,265 | 3/1988 | Nilsson et al. | 422/166 |
| 4,745,858 | 5/1988 | Harder | 102/202.2 |
| 5,140,906 | 8/1992 | Little, II . | |
| 5,337,674 | 8/1994 | Harris et al. | 102/530 |
| 5,345,872 | 9/1994 | Takahashi et al. | 102/202.2 |

FOREIGN PATENT DOCUMENTS

| | | | |
|---|---|---|---|
| 565696 | 2/1924 | France | 102/472 |
| 2020016 | 11/1971 | Germany . | |
| 3606364 | 9/1987 | Germany . | |
| 1187373 | 4/1970 | United Kingdom . | |
| 2238672 | 6/1991 | United Kingdom | 102/202.1 |

*Primary Examiner*—Harold J. Tudor

*Attorney, Agent, or Firm*—Antonelli, Terry, Stout & Kraus

[57] ABSTRACT

An electrical ignition device (1) has a metal container (2) for a firing resistor or bridge, a first (3) and a second (4) terminal pin and at least one ignition charge (5, 6).

So that firing of the ignition charge does not occur in the event of electrical discharges between terminal pins and a housing, it is proposed that the container (2) be capable of being embedded in a plastic material by injection moulding and inserted in the housing, that a first outward extension (8) be provided on the container (2) which is electrically conductively connected to the first terminal pin (3), and that a second outward extension (9) be provided on the container (2) which can be formed so as to extend to the housing leaving a small clearance and of which an outer end is not embedded in the plastic material.

12 Claims, 4 Drawing Sheets

IGNITION DEVICE

FIELD OF INVENTION

The invention relates to an ignition device having a metal container containing an ignition bridge, first and second terminals and at least one ignition charge.

BACKGROUND OF THE INVENTION

DE-OS 36 06 364 discloses an electrical igniter bridge support or device for ignition of ignition charges, delay charges and pyrotechnic mixtures and for firing primary detonation materials and charges. The igniter bridge support or ignition device includes a metal container with a cylindrical recess in which a ceramic body is placed. This ceramic body is provided with two bores into each of which a solid, tubular terminal pin is securely and tightly fitted. At the connection end these terminal pins project from the ceramic body, while at the ignition end they are connected together by way of an igniter bridge. An ignition charge is arranged in the container adjacent the igniter bridge. For firing a high enough voltage is applied across the terminal pins to cause the igniter bridge to burn abruptly, thus firing the ignition charge.

Such ignition devices can be used, for example, in pressure elements for use in seat-belt tensioners, buckle tighteners or in seat-belt retractors of motor vehicles. In case of an accident the ignition device is triggered by a sensor, causing a gas to be produced in the pressure element which moves, for example, a piston. The piston is connected to a cable on the belt buckle or to an automatic belt retractor and tightens the seat belt.

A disadvantage of this described ignition device is that externally induced electric fields can cause an electrostatic charge to build up between the terminal pins, which on discharge can lead to accidental firing of the ignition charge.

SUMMARY OF THE INVENTION

The object of the invention, therefore, is to provide an improved ignition device which, in the event of electrostatic discharges between the terminal pins and the housing, prevents firing of the ignition charge.

To achieve this object, according to the invention the container can be embedded in plastic material by injection moulding and can be inserted in a housing, the container is provided with a first outward extension which is in electrically conductive connection with the first terminal pin and the container is provided with a second outward extension which can be formed so as to extend up to an interior surface of the housing and provided with a small clearance so that an outer end of the extension is not embedded in plastic material.

Because the first terminal pin is electrically and conductively connected to the container and the container extends up to a surface of the housing through the second extension, any electrostatic discharge takes place between this second extension and the housing and thus well away from the ignition charge. The body of plastic material enables the container to be handled safely and easily. The housing is electrically conductive.

Advantageously the first terminal pin is connected to the first outward extension by welding, by soldering or brazing or by riveting. This produces a permanent and optimum connection.

In a preferred embodiment a ignition bridge element with an igniter bridge is arranged in the container. Such a firing means or ignition element is known in the art and is described, for example, in German patent 20 20 016 and U.S. Pat. No. 3,763,782. These elements are inexpensive to produce and provide precisely defined ignition bridges.

Advantageously the second terminal pin is anchored electrically and conductively in the ignition bridge element. This can be done, for example, by soldering or brazing. The ignition bridge is situated on the metal coated element between this second terminal pin and the container or the first terminal pin. This first terminal pin thus forms the other contact electrode for the bridge.

In a preferred embodiment, the first and second outward extensions are diametrically opposed to one another relative to the longitudinal axis of the container.

Advantageously, the container is cylindrical and made of brass and is embedded in injected a molded polyamide.

In a preferred embodiment the ignition device is installed in a housing charged with a gas generating material.

In an alternative embodiment, an annular recess is advantageously provided between the body of plastic material and the container in the region of the ignition charge. As a result of this recess, the mechanical impulse is not introduced directly into the body of plastic material.

Advantageously, the outward extensions are arranged at an end of the container opposite to the ignition charges. The outward extensions are preferably in the form of lugs, tabs, webs or the like and extend substantially radially of the longitudinal axis of the container. It may, however, be advantageous if the outward extensions merge into one another, i.e. form an annular collar or an annular flange around the container.

BRIEF DESCRIPTION OF THE INVENTION

Further features of the invention will be apparent from the following description and the accompanying drawings, wherein:

FIG. 1*a* shows an ignition device in accordance with the invention in longitudinal section and FIG. 1*b* shows a plan view of the device;

FIG. 2*a* shows a container of the device in accordance with the invention having a ignition bridge element, in longitudinal section and FIG. 2*b* shows the container in cross-section;

FIG. 3 shows a partial cross-sectional view of a pressure element with an ignition device installed in it; and FIG. 4 shows a partial cross-sectional view of an alternative ignition device in accordance with the invention, again installed in a pressure element.

DETAILED DESCRIPTION OF THE INVENTION

Figure 1A:
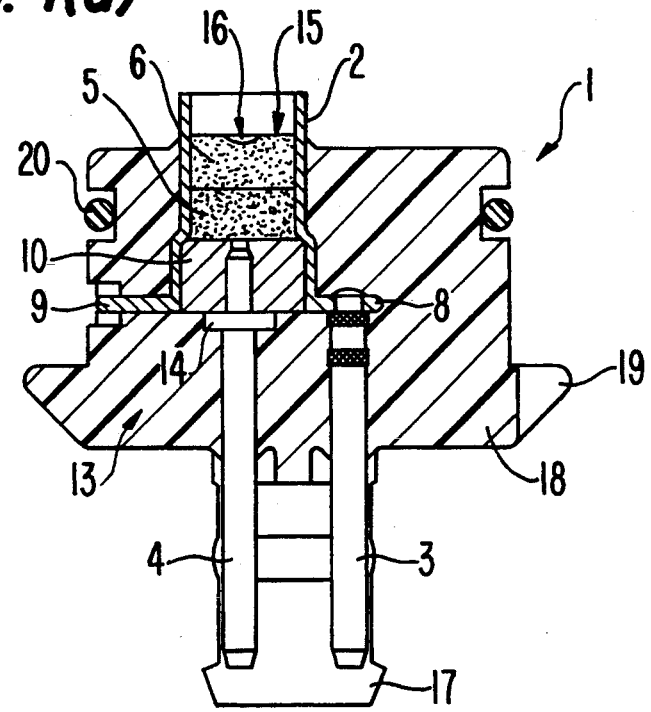
Figure 1B:
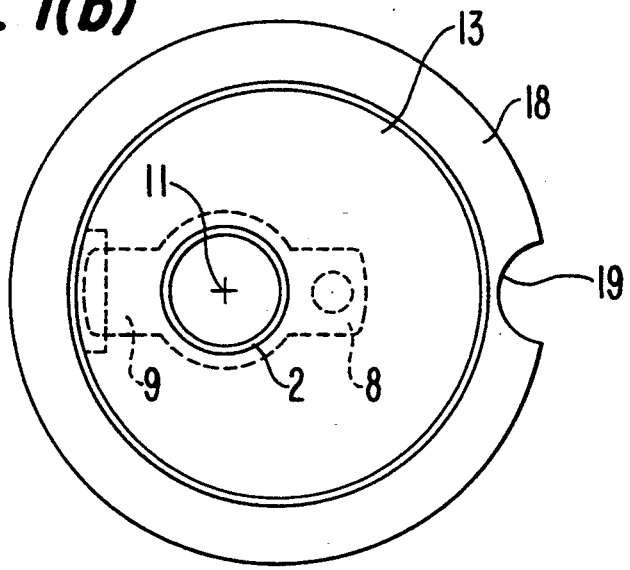
Figure 2A:
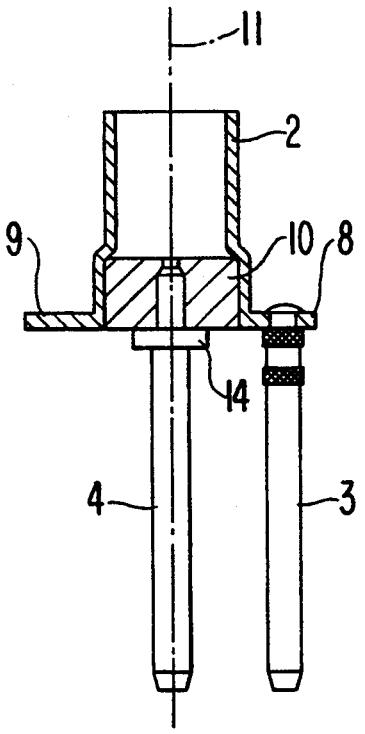
Figure 2B:
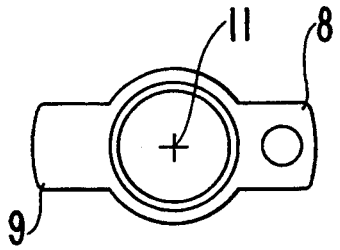

FIG. 1*a* shows an ignition device 1 having a container 2 provided with a body 13 of plastic material in a longitudinal section and FIG. 1*b* shows a plan view of the device from above. In FIGS. 2*a* and 2*b* the identical container 2 is shown, but without the ignition charge and the body of plastic material.

The container 2 is cylindrical and is made of metal (e.g. brass). At one end of the container an ignition bridge element 10 is inserted into the container 2. In the region of the element 10 the container 2 is slightly larger in diameter. On the element 10 is situated the ignition bridge 12, one pole of which is electrically connected to the housing of the container 2. The element for supporting the ignition bridge is made of ceramic, glass, or another material that does not conduct electricity; whereas, the ignition bridge comprises an electrically conductive metal strip or film such as tantalum or a noble metal extending between electrically conductive contact portions made of a noble metal or other suitable metal known for this purpose. At the end of the container 2 facing the metal coated element are arranged two tab-shaped outward extensions 8, 9, diametrically opposed to one another relative to the longitudinal axis 11. These extensions 8, 9 extend at right angles to the housing of the container 2 and at their lower side run flush with the lower end face of the metal coated element 10 that is located there. A first terminal pin 3 is riveted or welded, preferably soldered or brazed, into the first outward extension 8 and extends parallel to the longitudinal axis 11 of the container 2. A second terminal pin 4 is inserted into the metal coated element 10 and has a flange 14 which abuts against the lower end face of the metal coated element 10 to restrict the depth of insertion. This second terminal pin 4 is arranged along the longitudinal axis of the container 2.

FIG. 2*b* shows the arrangement and form of the tab-shaped outward extensions 8, 9.

On the element 10 inside the container 2 is arranged a first ignition charge 5, and above this a second ignition charge 6 (see FIG. 1*a*). The second ignition charge 6 is provided with a protective layer or coating 15. A dish-shaped indentation 16 is formed in the middle of the second ignition charge 6.

The container 2 is surrounded with a body 13 of polyamide plastic material. Other plastic materials (e.g. polyether sulphone) or composite materials can, however, be used. Projecting from the body 13 of plastic material are the upper end of the container 2, the terminal pins 3, 4 and the end of the second outward extension 9. A space or clearance 27 is provided around the terminal end of extension 9. By "upper" is basically to be understood the ignition side and by "lower" the electrical connection side.

The second outward extension 9 extends to close to the outer peripheral wall of the body 13 of plastic material. At the lower end of the body 13, there is a shoe 17 adjacent the terminal pins 3, 4 which serves for attachment of known connecting plugs or jacks. A connecting jack short-circuits the two terminal pins 3, 4 when the plug is not inserted.

Above the shoe 17 there is a flange 18 with a notch 19. The flange 18 is used to install the ignition device 1 in a pressure element housing (see FIG. 3). The notch 19 enables the ignition device 1 to be positioned in the manufacturing process. An annular seal 20 in the form of an O-ring is arranged on the outer wall of the body 13 of plastic material above the second outward extension 9.

Figure 3:
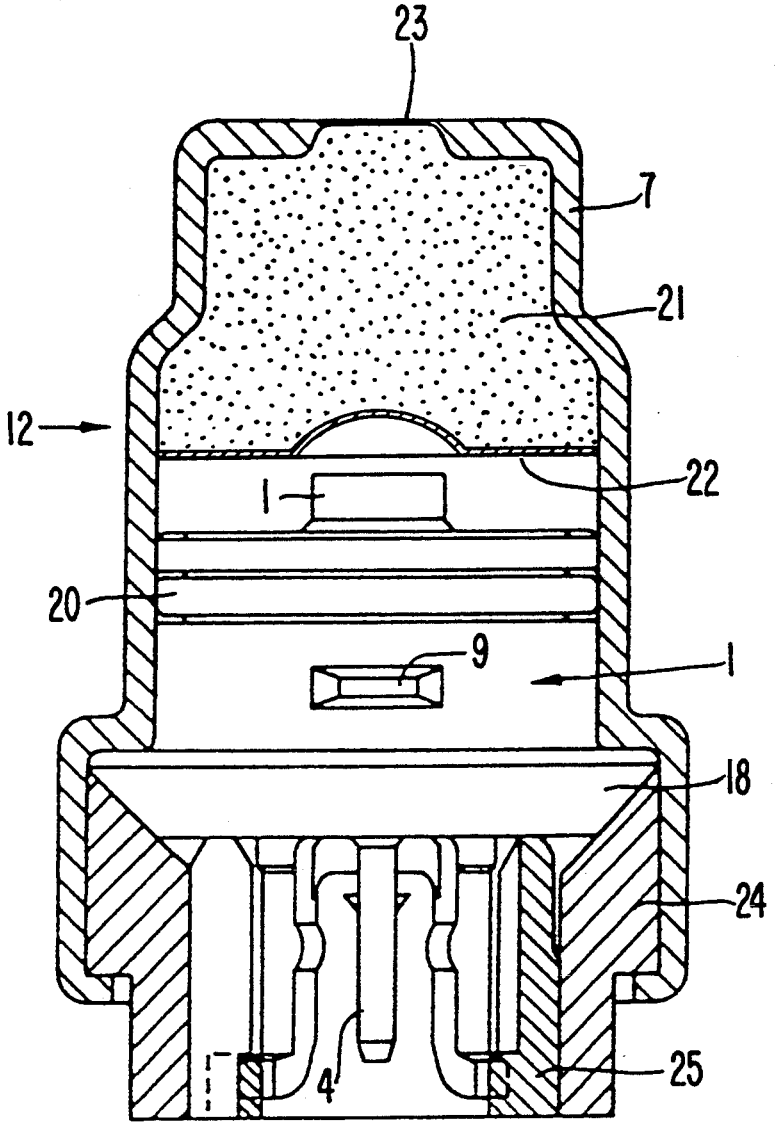

FIG. 3 shows the ignition device 1 of FIGS. 1*a*, 1*b* and 2*a*, 2*b* installed in a pressure element 30. The housing 7 of the pressure element 30 almost completely surrounds the ignition device 1 and fits closely over the outer wall of the plastic body 13. The housing 7 of the pressure element 30 forms a cavity above the ignition device, in which cavity there is a gas-generating charge 21 which is protected on its underside by a covering foil 22. In the upper side of the housing 7 there is a rupture point 23 through which the gas that is set free can leave the pressure element 30. The flange 18, heretofore described, bears on an edge of the housing 7, with a cone surface in a part 24 pressing the flange 18, and thereby the ignition device, sealingly against the housing 7. At the lower end of the ignition device, a known shorting jack 25 is shown which short-circuits the two terminal pins 3, 4 when the plug is not inserted. According to the invention the tab-shaped second outward extension 9 projects to near the housing 7 of the pressure element 30. In case of electrostatic discharges between a terminal pin 3, 4 and the housing 7 a power flashover therefore occurs in a zone that is well away from the ignition charges 5, 6 in the ignition device 1. This arrangement thus provides protection from electrostatic discharges.

Figure 4:
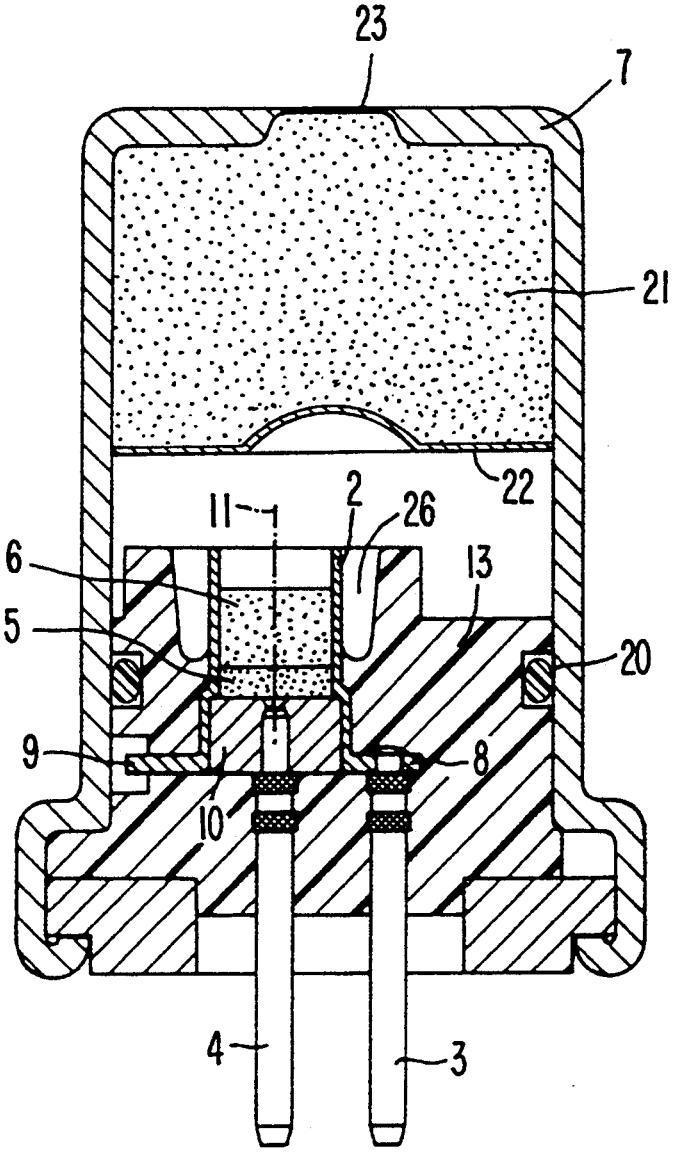

FIG. 4 shows an alternative ignition device. The alternative consists in that the plastic body 13 has an annular recess 26 in the upper region of the container 2. As a result of this, the container or brass shell 2 in which the ignition charges 5, 6 are located lies free in the upper region. This has the advantage that, on firing, the mechanical impulse (shock load) is not introduced directly into the plastic body. The recess 26 extends almost the whole length of the second ignition charge 6. The lower end of the recess 26 is formed with a radius.

The pressure element 31 described in FIG. 4 also shows an embodiment without a connecting socket. Here the contact between the terminal pins 3, 4 and the supply line is effected by means of a soldered connection or of a clamped joint.

The annular seal 20 shown in the figures also serves to protect the gas-generating charge 21 against moisture.

High strength plastic materials are often very susceptible to stress cracking. The container 2 reduces the stresses in the plastic body which are set up by the pressing in of the ignition charges, so that no long-term cracks form in the plastic body.

What is claimed is:

1. An electrical ignition device which comprises a metal container containing an ignition bridge in electrical contact therewith, a first terminal pin connected to the container, a second terminal pin connected to the bridge and at least one ignition charge within the container, said container being embedded in a plastic material and the plastic embedded container being positioned within a housing, a first outward extension provided on the container, said extension being electrically and conductively connected to the first terminal pin, and a second outward extension provided on the container, said second outward extension having an outer end and being arranged to extend within the plastic material positioned in said housing leaving a small clearance between the housing and the outer end, said outer end not being embedded in the plastic material.

2. An ignition device according to claim 1, wherein the first terminal pin is connected to the first outward extension by a metal connection.

3. An ignition device according to claim 1 or claim 2, wherein an ignition bridge element having the ignition bridge formed thereon is arranged in the container.

4. An ignition device according to claim 3, wherein the second terminal pin is anchored in the ignition bridge element and electrically connected to the ignition bridge.

5. An ignition device according to claim 1, wherein the first and second outward extensions are diametrically opposed relative to a longitudinal axis of the container.

6. An ignition device according to claim 1, wherein the container is made of brass.

7. An ignition device according to claim 1, wherein the container is cylindrical.

8. An ignition device according to claim 1, wherein the container is embedded in a polyamide material.

9. An ignition device according to claim 1, for use with an air bag, said housing further containing a gas-generating material which is ignitable by said ignition bridge.

10. An ignition device according to claim 1, wherein the container is embedded within a body of the plastic material and an annular recess is provided between the body of the plastic material and the container in a region of the container wherein the at least one ignition charge is located.

11. An ignition device according to claim 1, wherein the outward extensions are located at an end of the container opposite to a location of the at least one ignition charge.

12. An ignition device according to claim 1, wherein the outward extensions are tabs and extend substantially radially of the longitudinal axis of the container.

* * * * *